US005789873A

United States Patent [19]

Jeong

[11] Patent Number: 5,789,873

[45] Date of Patent: Aug. 4, 1998

[54] VIDEO DISPLAY APPLIANCE INCLUDING DEVICE FOR SHIELDING ELECTRO-MAGNETIC FIELD EMITTED FROM DEFLECTION YOKE

[75] Inventor: Seok Hwa Jeong, Ktoungsangbuk-Do, Rep. of Korea

[73] Assignee: LG Electronics, Seoul, Rep. of Korea

[21] Appl. No.: 763,543

[22] Filed: Dec. 10, 1996

[30] Foreign Application Priority Data

Apr. 1, 1996 [KR] Rep. of Korea ..... 1996 9783

[51] Int. Cl.[6] ..... H01J 29/56

[52] U.S. Cl. ..... 315/370; 315/8; 315/85

[58] Field of Search ..... 315/370, 8, 85; 361/150

[56] References Cited

U.S. PATENT DOCUMENTS

| | | | |
|---|---|---|---|
| 4,634,930 | 1/1987 | Toshiyasu et al. | 315/8 |
| 4,947,083 | 8/1990 | Bosch et al. | 315/8 |
| 5,017,832 | 5/1991 | Takita | 315/370 |
| 5,350,973 | 9/1994 | Yokota et al. | 315/8 |
| 5,400,088 | 3/1995 | Jones | 315/85 |
| 5,416,595 | 5/1995 | Wield | 315/8 |
| 5,568,112 | 10/1996 | Cure | 335/214 |

*Primary Examiner*—Theodore M. Blum

*Attorney, Agent, or Firm*—Oppenheimer Wolff & Donnelly LLP

[57] ABSTRACT

A video display appliance comprising a cathode ray tube 2 having a deflection yoke 22 mounted thereto, a cabinet 4, and a back cover 6, the cabinet and the back cover being connected to house the CRT. The video display appliance also comprises a magnetic field absorbing coil 30 placed between a glass envelope 12 and the deflection yoke 22, a magnetic field remover 25, a back plate 34 mounted on a video board 27, a below plate 28, and a shielding member 60, 160 or 260 secured detachable to the inner surface of the back cover 6, for shielding the electromagnetic field emitted from the deflection yoke. The shielding means comprises an oblong closed-loop wire 62, 162, 262 or 265, and lead wires 64 having at each end a ground terminal. Accordingly, the electric field emitted in an upward direction from the deflection yoke is easily eliminated by means of the shielding member having a simple construction and being easily installed.

7 Claims, 4 Drawing Sheets

VIDEO DISPLAY APPLIANCE INCLUDING DEVICE FOR SHIELDING ELECTRO-MAGNETIC FIELD EMITTED FROM DEFLECTION YOKE

BACKGROUND OF THE INVENTION

1. Field of the Invention

The present invention relates generally to a video display appliance such as a television receiver, a computer monitor, etc., and more particularly to a video display appliance including a device for shielding the electromagnetic field emitted from a deflection yoke.

2. Description of the Prior Art

A common video display appliance comprises a cathode ray tube (CRT), a cabinet, and a back cover. The cabinet and the back cover are made of a thermoplastic material, and coupled to each other so as to accommodate the CRT therein. The CRT has a high vacuum space therein, and comprises, a funnel-shaped glass envelope having a viewing faceplate and a neck, electron guns mounted in the neck for radiating electron beams, and a deflection yoke mounted on the outside of the neck.

In such a cathode ray tube as described above, the electron beams radiating from the cathodes of the electron guns are controlled, accelerated, and focussed by conventional means, and then irradiated on a fluorescent screen formed on the back side of the faceplate. During these processes, the electron beams are deflected by a magnetic field produced from the deflection yoke composed of a vertical deflection coil and a horizontal deflection coil. The deflection yoke produces a magnetic field in response to a deflection current and a deflection voltage applied to the deflection coils. Around the deflection coils, a magnetic field expressed as the below equation (I) and an electric field expressed as the below equation (II) are produced.

$$H = NI\frac{1}{2\pi r}\ [AT/m] \tag{I}$$

wherein, H is a strength of magnetic field, N is a number of turns of the coil, I is a current flowing through the deflection coil, and r is a radius of the coil.

$$E = \frac{V}{d}\ [V/m] \tag{II}$$

wherein, E is a strength of electric field, V is a voltage being applied to the deflection coil, and d is a distance of the coil.

According to the above equations, the magnetic field H and the electric field E are produced in proportion to the current and the voltage applied thereto. The magnetic and electric fields affect the deflection of the electron beams, while partially emitted or leaked from the video display appliance as an electromagnetic wave.

Because the electromagnetic wave is harmful to the human body, the statutory restriction on electromagnetic wave emissions is becoming tighter in most countries. Accordingly, there have been proposed several methods for removing the leakage electromagnetic wave.

According to one of the methods, a magnetic field remover and a magnetic field suppressing coil are respectively provided in the upper and the front of the deflection yoke in order to shield the magnetic field emitted from the deflection coil. Also, in order to shield the electric field, a video board positioned in the back of the neck and a main board positioned in the lower of the neck are provided with metallic shield plates, respectively. With the above described construction, the magnetic field leaking in forward and upward directions, and the electric field leaking in rearward and downward directions can be substantially shielded.

The prior art video display appliance as described above, however, has a problem that it fails to remove the electric field leaking in the upward direction from the deflection coil. To eliminate the electric field emitted in the upward direction, there has been proposed a method of increasing the effect of the electric field by increasing the size of the video board. In the method, the neck may be damaged as its mechanical stability is diminished. Also, the large-sized video board may prevent heat produced from several components of the video display appliance from being discharged out of the appliance.

SUMMARY OF THE INVENTION

It is an object of the present invention to solve the problems involved in the prior art, and to provide a video display appliance capable of shielding the electro-magnetic wave emitted from the deflection yoke.

Another object of the present invention is to provide a video display appliance capable of shielding the electric field emitted from the deflection yoke.

A further object of the present invention is to provide a device having a simple construction for shielding the electric field emitted from the deflection yoke.

In order to achieve the above objects, there is provided a video display appliance including a cathode ray tube having a deflection yoke mounted thereon, a back cover, members for shielding the magnetic field emitted from the deflection yoke, and metallic plates for shielding the electric field emitted from the deflection yoke, the video display appliance comprising a means, including at least one closed-loop wire secured to an inner surface of the back cover, for shielding the electric field emitted upwardly from the deflection yoke.

With the above described construction, the electromagnetic field emitted from the deflection yoke can be substantially shielded. Particularly, the electric field emitted upwardly from the deflection yoke can be eliminated by means of the shielding means having a simple construction and being easily installed.

Preferably, the electric field shielding means may comprise two lead wires having a ground terminal coupled at each end thereof. Preferably, the closed-loop wire has an oblong shape, and also has a good electric conductivity and high magnetic permeability.

In order to increase the effect for shielding the electric field emitted from the deflection yoke, the electric field shielding means may comprise a plurality of closed-loop wires connected to each other in parallel. Alternatively, the closed-loop wire may include two wires, both ends of which are respectively connected to predetermined points of the closed-loop wire. The center portions of the two wires are crossed with each other.

The back cover has a plurality of holders formed thereon to secure the electric field shielding means. Each upper portion of the holders is opened, so that the opening of the holder can be elastically deformed in press. Accordingly, the closed-loop wire is detachably secured to the holders.

BRIEF DESCRIPTION OF THE DRAWINGS

The above objects, other aspects, and advantages of the invention will become apparent by describing the preferred embodiments thereof with reference to the accompanying drawings, in which.

DETAILED DESCRIPTION OF THE PREFERRED EMBODIMENTS

Figure 1:
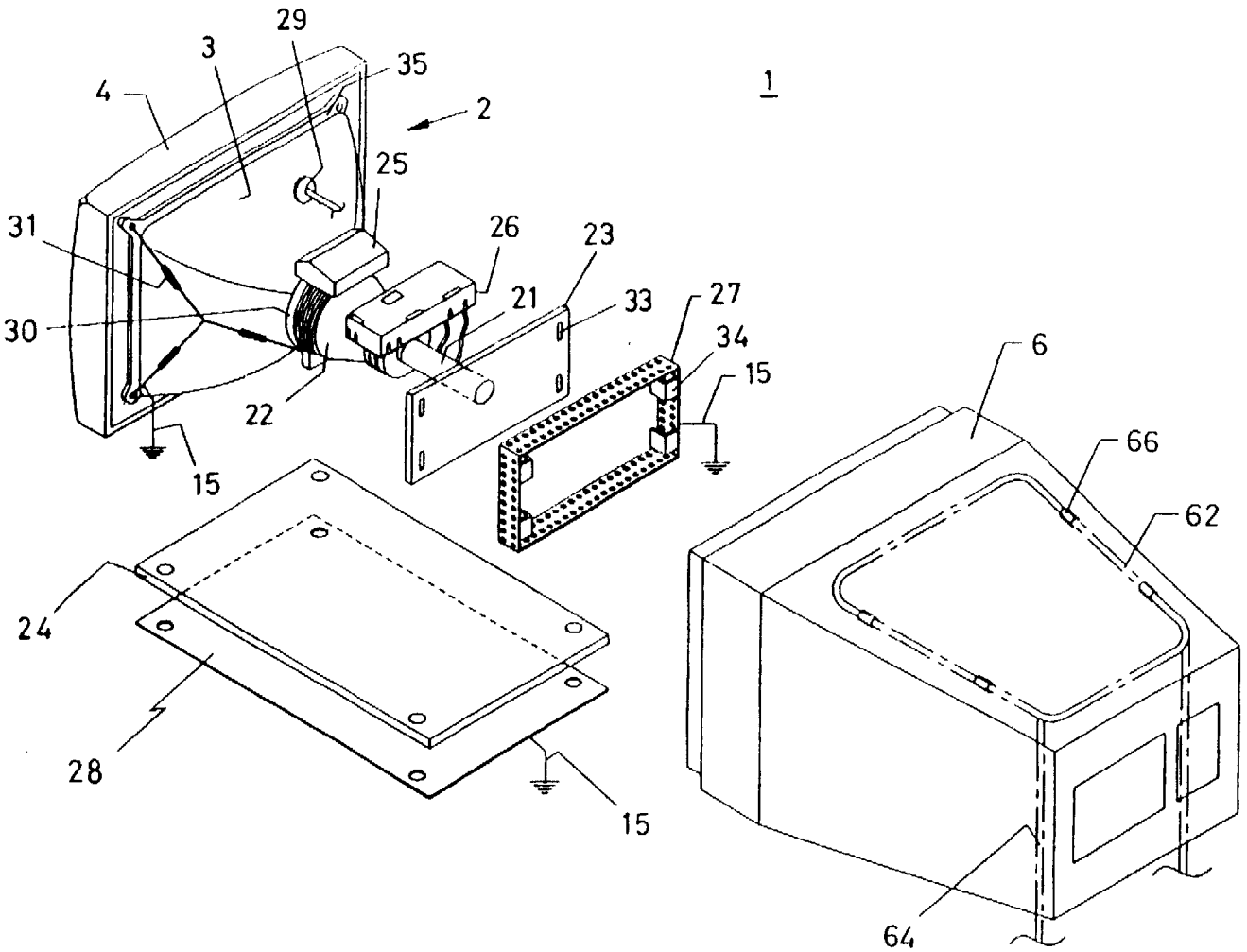
FIG. 1 is an exploded perspective view showing a video display appliance having an electric field shielding member according to the present invention.

Referring now to FIG. 1, there is shown a video display appliance, generally designated by reference numeral 1, comprising a cathode ray tube (CRT) 2, a cabinet 4, and a back cover 6. The cabinet and the cover are made of any thermoplastic material, and coupled to each other so as to accommodate the CRT therein. The CRT 2 has a high vacuum space therein, and comprises a funnel-shaped glass envelope 32 having a viewing faceplate (not shown) and a neck 21, electron guns (not shown) mounted in the neck 21 for radiating electron beams, and a deflection yoke 22 mounted around the neck 21.

The deflection yoke 22 generally includes a transverse coil and a vertical coil. The deflection yoke 22 produces the electro-magnetic wave in response to the current and voltage applied to the deflection coils. Electron beams radiating from the cathode of the electron gun are deflected by means of the electromagnetic wave, and then irradiated on a fluorescent screen formed on a back side of the faceplate. Generally, the deflection yoke 22 also includes a coil 30 for suppressing a magnetic field leaking out in the forward direction of the yoke 22 and a remover 25 for eliminating a magnetic field emitted upwardly from the yoke 22.

The CRT 2 includes a video board 23 mounted on the back side of the neck 21 and a main board 24 mounted underneath the neck 21. The CRT 2 is actuated with the video board 23 and the main board 24. The video board 23 has a rectangular shape, and is provided with a number of through slots 33, e.g., 4 in the shown embodiment. In general, the video board 23 has a back shielding plate 27 that is made of metal and has a number of protrusions 34 corresponding to the number of slots 33. The back plate 27 is grounded through a ground line 15. A shielding plate 28 made of metal is mounted on the lower of the main board 24 by means of a conventional means, such as bolts (not shown), and the lower plate 28 is also grounded through a ground line 15.

An anode cap 29 is attached to a predetermined point on the glass envelope 32, and connected electrically to the high voltage terminal of a flyback transformer (not shown) via a conductor. The magnetic field suppressing coil and a flange 35 placed in the peripheral of the glass envelope 32 are connected with each other through an electric conductor 31. The conductor 31 is grounded through a ground line 15. A terminal box 26 of the deflection yoke 22 is provided at an upper area of the neck 21.

Figure 3:
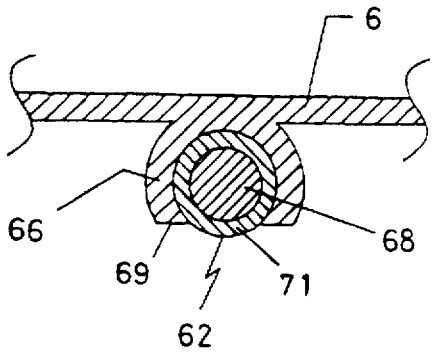
FIG. 3 is an enlarged cross-sectional view of a holder formed integrally with the upper inner surface of the back cover for securing the electric field shielding member.

Referring to FIGS. 1 and 3, the back cover 6 includes a member 60, 160 or 260 for shielding an electric field emitted upwardly from the deflection yoke 22. Also, the back cover 6 includes a plurality of holders 66, preferably 4, which are formed on the upper inner surface in its molding for detachably securing the shield member. To the end, each of the holders 66 has an opening 69, a portion of which is opened, and at least two holders are positioned in a line. The each holder 66 has a diameter such that a wire 62 of the electric field shielding member 60 can be press-fitted thereto, and a length thereof can be selected variously, if necessary. The upper, i.e., longitudinal side of the holder 66 is opened so that the opening 69 is elastically expanded upon pressing from the upper.

Figure 2:
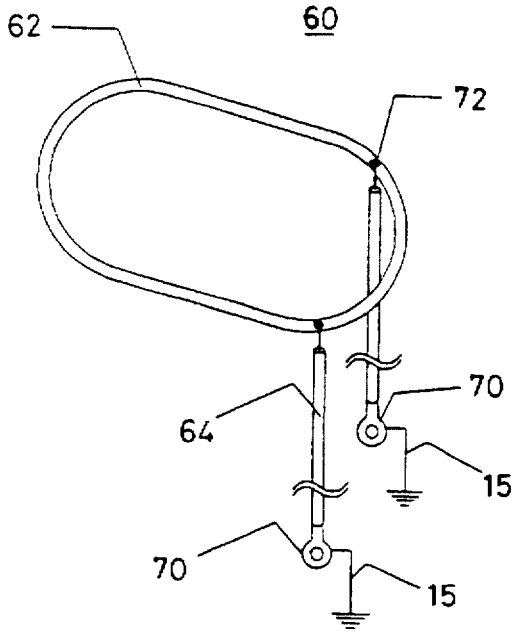
FIG. 2 is a perspective view of an electric field shielding member according to a first embodiment of the present invention.

Referring now to FIG. 2, there is shown an electric field shielding member 60 according to a first preferred embodiment of the invention. The shielding member has a wire 62 formed of an oblong closed loop. The wire 62 comprises a conductor 68 made of a diamagnetic material having a good electric conductivity and high magnetic permeability, and a sheath 71 made of an insulation. At least two parts 72 of the wire 62 are connected to each end of lead wires 64 by means of a conventional method such as welding. The other end of the lead wire 64 has a ground terminal 70 in order to ground the electric field flowing through the wire.

With the aforementioned construction, when the current flows through the coils of the deflection yoke 22 by applying a high voltage to it, the coils of the deflection yoke 22 produce an electric field and a magnetic field in proportion to the current applied thereto. The produced magnetic field functions as a means for deflecting the electron beam irradiating from the electron gun. Meanwhile, such magnetic field is emitted outwardly from the deflection yoke 22, causing a negative effect on a peripheral apparatus, as well as a human body.

Figure 6:
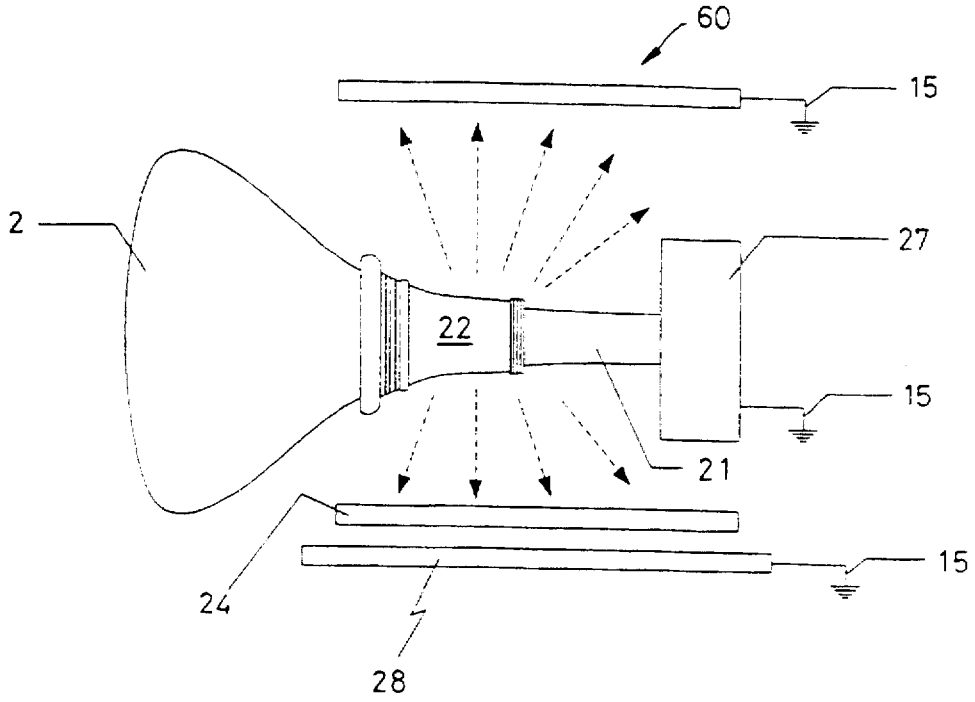
FIG. 6 is a view illustrating that emission of the electric field from the video display appliance is prevented by means of the electric field shielding member according to the present invention.

According to the invention, referring to FIG. 6, the emitted electric field is shielded by means of the back plate 27 coupled to the video board 23, the lower plate 28 and the shielding member 60, 160 or 260 provided detachably on the upper inner surface of the back cover. The magnetic field is shielded by means of the coil 30 and the remover 25 each attached to the front and upper of the deflection yoke 22.

Figure 4:
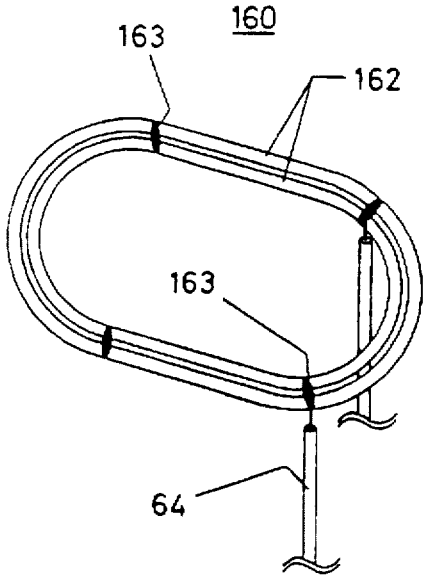
FIG. 4 is a perspective view of an electric field shielding member according to a second embodiment of the present invention.

FIG. 4 shows an electric field shielding member 160 of a second embodiment, similar to the aforementioned first embodiment except for having a number of wires 162. The shown shielding member 160 has a number of, 2 in the shown embodiment, wires 162 connected in parallel with each other to increase an effect for shielding the electric field. In this case, a conventional means may be used in order to connect the wires 162 to each other. Each of the two lead wires 64 is connected to it through a contacting portion 163. And, the upper inner surface of the back cover can be provided with a plurality of wire holders corresponding to the number of the shielding wires to be used, which are not shown in FIG. 4.

Figure 5:
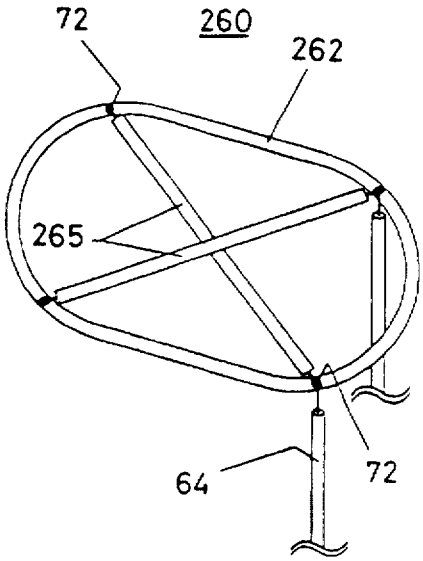
FIG. 5 is a perspective view of an electric field shielding member according to a third embodiment of the present invention.

Also, FIG. 5 shows an electric field shielding member 26 of a third embodiment according to the invention. The shown shielding member 260 includes a closed-loop wire 262 and two wires 265, and both ends of the wires 265 are respectively connected to the closed-loop wire 262. The center portions of the two wires are crossed, not connected each other.

While the present invention has been described and illustrated herein with reference to the preferred embodiments thereof, it will be understood by those skilled in the art that various changes in form and details may be made therein without departing from the spirit and scope of the invention.

What is claimed is:

1. A video display appliance including a cathode ray tube having a deflection yoke mounted thereon, a back cover, members for shielding the magnetic field emitted from said deflection yoke, and metallic plates for shielding the electric field emitted from said deflection yoke, the video display appliance comprising:

means, including at least one closed-loop lead wire secured to an inner surface of said back cover and having a ground terminal coupled thereto, for shielding the electric field emitted upwardly from said deflection yoke.

2. The video display appliance as claimed in claim 1, wherein said closed-loop wire has an oblong shape.

3. The video display appliance as claimed in claim 1, wherein said back cover is formed with a number of holders for securing said electric field shielding means, and each upper portion of said holders is opened, thereby elastically deforming when pressed.

4. The video display appliance as claimed in claim 3, wherein said closed-loop wire is detachably secured to said holders.

5. The video appliance as claimed in claim 1, wherein said at least one lead wire comprises two lead wires, each having a ground terminal coupled thereto.

6. A video display appliance including a cathode ray tube having a deflection yoke mounted thereon, a back cover, members for shielding the magnetic field emitted from said deflection yoke, and metallic plates for shielding the electric field emitted from said deflection yoke, the video display appliance comprising:

means, comprising a plurality of closed-loop wires connected to each other in parallel and secured to an inner surface of said back cover, for shielding the electric field emitted upwardly from said deflection yoke.

7. A video display appliance including a cathode ray tube having a deflection yoke mounted thereon, a back cover, members for shielding the magnetic field emitted from said deflection yoke, and metallic plates for shielding the electric field emitted from said deflection yoke, the video display appliance comprising:

means, including at least one closed-loop wire secured to an inner surface of said back cover, for shielding the electric field emitted upwardly from said deflection yoke, wherein said closed-loop wire includes two wires both ends of which are respectively connected to predetermined points of said closed-loop wire, and the center portions of said wires are crossed with each other.

* * * * *